United States Patent [19]

Kristoffersson

[11] 4,387,765

[45] Jun. 14, 1983

[54] ARRANGEMENT FOR LOCATING THE PLATES INCLUDED IN A PLATE HEAT EXCHANGER

[75] Inventor: Ingmar Kristoffersson, Rönninge, Sweden

[73] Assignee: Alfa-Laval AB, Tumba, Sweden

[21] Appl. No.: 332,877

[22] Filed: Dec. 21, 1981

[30] Foreign Application Priority Data

Dec. 22, 1980 [SE] Sweden ..... 8009081

[51] Int. Cl.[3] ..... F28F 3/08

[52] U.S. Cl. ..... 165/166

[58] Field of Search ..... 165/76, 78, 166, 167

[56] References Cited

FOREIGN PATENT DOCUMENTS 309785 10/1963 Sweden .
39558 10/1963 United Kingdom .
1129924 10/1968 United Kingdom .

*Primary Examiner*—Sheldon J. Richter
*Assistant Examiner*—John F. McNally
*Attorney, Agent, or Firm*—Fleit, Jacobson & Cohn

[57] ABSTRACT

This invention relates to arrangement in heat exchangers, comprising a large number of heat exchange plates which, in compressed position, form throughflow passages for the heat exchange media, a first preferably stationary end wall situated on one side of the heat exchange plates and a second end wall situated on the opposite side of said plates and adapted to be displaced by clamping means towards said first end wall in order to sealingly compress the heat exchange plates, said preferably stationary end wall supporting a bar projecting therefrom and extending through recesses arranged in the heat exchange plates in order to locate said plates mutually and relative to the end walls against displacement in the plane of the plates when the clamping means are disconnected and/or the second end wall is removed, said bar having a length exceeding the distance between the end walls in the position where they compress the plates.

According to the invention the bar which is detachably fitted to the first end wall, has close to said wall a stationary abutment serving as an end stop for the plates in one direction and at its opposite end wall a means being withdrawable against spring action and serving as an end stop, said means being spaced from said first abutment exceeding the total thickness of the heat exchange plates.

7 Claims, 1 Drawing Figure

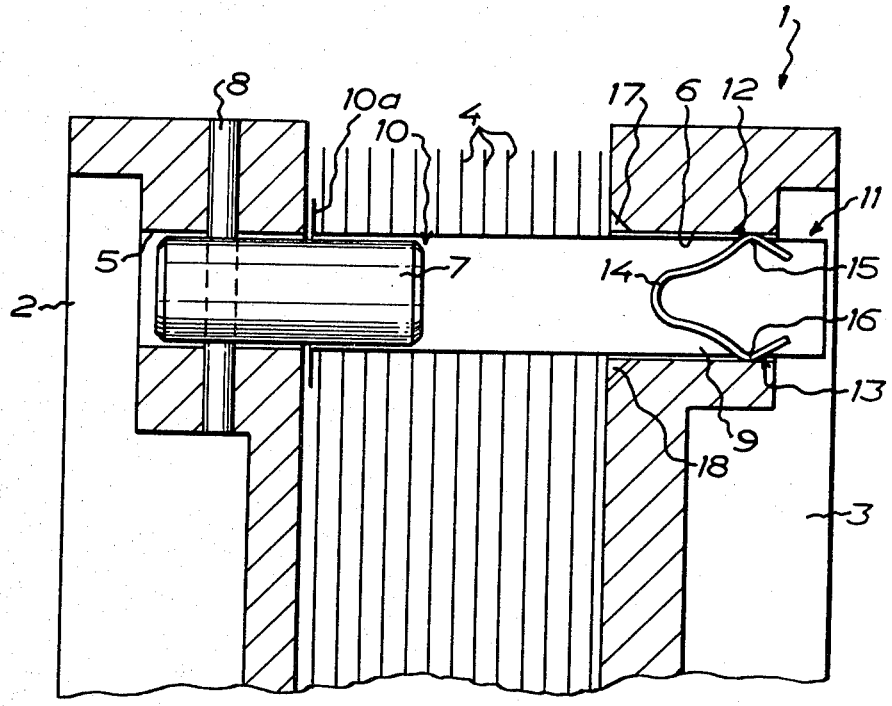
1
8
10a
10
4
17
6
12
11
5
7
14
15
2
16
13
9
18
3

ARRANGEMENT FOR LOCATING THE PLATES INCLUDED IN A PLATE HEAT EXCHANGER

The present invention relates to an arrangement in heat exchangers, comprising a large number of heat exchange plates which, in compressed position, form throughflow passages for the heat exchange media, a first preferably stationary end wall situated on one side of the heat exchange plates and a second end wall situated on the opposite side of said plates and adapted to be displaced by clamping means towards said first end wall in order to sealingly compress the heat exchange plates, said preferably stationary end wall supporting a bar projecting therefrom and extending through recesses arranged in the heat exchange plates in order to locate said plates mutually and relative to the end walls against displacement in the plane of the plates when the clamping means are disconnected and/or the second end wall is removed, said bar having a length exceeding the distance between the end walls in the position where they compress the plates.

When dismantling and handling the plates in a plate heat exchanger one has hitherto threaded the plates on long carrying bars to be able to move them backwards and forwards along the bars for cleaning. This construction has proved expensive and too bulky especially for transportation and installation. As the plate pack cannot be removed from the carrying frame, also the cleaning, which is carried out manually, is rendered difficult.

The object of the present invention is to provide an arrangement for location of the plates during such handling, which arrangement is reliable and simple in function and design and allows removal of the plate pack, without dismantling each separate plate piece by piece, as well as replacement of discarded plates without trouble.

This object is achieved by the present invention in that the bar, which is detachably fitted to the first end wall, has close to said wall a stationary abutment serving as an end stop for the plates in one direction and at its opposite end a means being withdrawable against spring action and serving as an end stop, said means being spaced from said first abutment at a distance exceeding the total thickness of the heat exchange plates.

Preferred embodiments of the invention have been given the characteristics featured in the subclaims.

The invention will be described in greater detail hereinbelow with reference to the accompanying drawing which shows a partial cross-section through a plate heat exchanger with a coupling arrangement according to a preferred embodiment of the invention.

Referring now to the drawing the upper part of a plate heat exchanger 1 is shown, comprising two end walls 2, 3 and a number of plates 4 clamped therebetween. Provided in the end walls are holes 5, 6 which are situated straight opposite to each other when the heat exchanger is assembled. The hole 5 in one end wall 2 is intended to receive a pin 7 which is locked up in said hole by means of a spring rod 8 or the like. The pin 7 may for instance be made of moulded plastics material. This pin 7 projects from the hole 5 into the space between the end walls and can be introduced into one end of a tube 9. Provided in the plates are recesses which are situated straight opposite to each other and form part of a means fixing the plates and which are adapted to receive the tube. Various embodiments of the means fixing the plates will be described in greater detail below. The other hole 6 in the end wall 3 is adapted to receive the other end of the tube.

The tube 9 is provided at one end with a flange 10 which forms an end stop preventing the plates threaded thereon from sliding off the tube. Two opposite, radially directed holes 12 and 13 are made in the other end 11 of the tube. A spring 14 forming a second end stop is fitted in the tube and takes the form of a "U" with bent-out projections 15, 16 which are directed outwardly at the ends of the shanks and placed in said holes 12, 13 at the other end 11 of the tube 9. Other embodiments of said stop means will be described in more detail below.

The length of the tube 9 is greater than the total thickness of the plates, which results in that the plates threaded on the tube will be movable backwards and forwards along it and also are turnable thereon when the plate heat exchanger is dismantled. This facilitates considerably the cleaning and the maintenance of the heat exchanger.

The function of the spring is such that, when the tube 9 is introduced into the hole 6 in the end wall 3, the projections 15, 16, formed on the spring and retaining the plates on the tube in dismantled position, are carried inwards towards the interior of the tube by means of bevels 17, 18 on the end wall 3 at the end of the hole 6 facing the other end wall, whereby the tube can be introduced into said hole 6.

The pin 7 can also be made in one piece with the end wall 2. This pin constitutes a guide for the coupling arrangement according to the invention when this is to be assembled with the plates and the end walls to form a plate heat exchanger.

The plates shown in the drawing are provided with recesses in the form of preferably circular holes which have the same form as the tube to be passed through them. As mentioned above, these holes form part of a means fixing the plates. They are circular in shape in order to permit turning of the plates mounted on the tube when this is dismantled from the end wall, for instance for cleaning purposes.

The fixing means may also take the form of a recess at the edge of the plate and in that case the recess is open, and a notch, which is wider than the thickness of one plate, may for instance be made on at least one side of the tube to permit removal of plates therefrom. When a single notch is made the tube may be so placed during cleaning or maintenance of the plates that the notch is situated on the underside of the tube so that the plates cannot slide off.

The fixing means may also consist of a projection on the plate, comprising a head portion and a narrower neck portion merging in the plate. The tube carrying the plates is in this case provided with a longitudinal slot. The head portion of the projections is fitted in the interior of the tube while the neck portion is situated in said slot. The width of the slot may be varied but should be as great as to permit the plates to be turned sideways to a certain extent.

It is understood that it must not necessarily be a tube that carries the plates but the plates may be carried by a solid bar or the like at the ends of which guiding and stopping means are arranged in a suitable manner.

The end stop means may for instance consist of stationary beads at the ends of the bar, said holes in the end walls being shaped to conform with the geometry of the bar including said beads. The stop means may of course also consist of, for instance, a pair of radially directed holes made at least at one end of the bar and including pins which are spring-biased in outward direction and thus correspond to the aforementioned projections 15 or 16.

The embodiment described above is of course not limitative but may be modified in various ways within the scope of the appended claims.

What I claim and desire to secure by Letters Patent is:

1. Arrangement in heat exchangers, comprising a large number of heat exchange plates (14) which, in compressed position, form throughflow passages for the heat exchange media, a first preferably stationary end wall (2) situated on one side of the heat exchange plates (4) and a second end wall (3) situated on the opposite side of said plates and adapted to be displaced by clamping means towards said first end wall in order to sealingly compress the heat exchange plates, said preferably stationary end wall (2) supporting a bar (10) projecting therefrom and extending through recesses arranged in the heat exchange plates in order to locate said plates mutually and relative to the end walls against displacement in the plane of the plates when the clamping means are disconnected and/or the second end wall is removed, said bar having a length exceeding the distance between the end walls in the position where they compress the plates, wherein the bar (9), which is detachably fitted to the first end wall (2), has close to said wall a stationary abutment (10) serving as an end stop for the plates in one direction and at its opposite end wall a means (15, 16) being withdrawable against spring action and serving as an end stop, said means being spaced from said first abutment (10) at a distance exceeding the total thickness of the heat exchange plates.

2. Arrangement as claimed in claim 1, wherein the bar consists of a tube (9) which is adapted, adjacent its end situated at the preferably stationary end wall, to cooperate with a guide pin or the like (7) arranged at said end wall.

3. Arrangement as claimed in claim 2, wherein the tube (9) has at its end engaging with the guide pin (7) an external flange, bead or the like (10) forming the abutment serving as one of the end stops and has at its opposite end at least one radial opening (12, 13) through which at least one means (15, 16) projects, which means is displaceable in inward direction against the action of a spring (14).

4. Arrangement as claimed in claim 1, wherein the recesses in the heat exchanger plates consist of closed holes.

5. Arrangement as claimed in claim 1, wherein the recesses in the heat exchanger plates are undercut recesses extending from the plate edge, in which the mouth portion has a smaller cross-sectional extent than the cross-section of the bar in the horizontal plane.

6. Arrangement as claimed in claim 5, wherein the bar is provided with at least one, suitably vertical, transversely extending notch permitting removal of the plates transversely of the longitudinal direction of the bar.

7. Arrangement as claimed in claim 3, wherein the spring (14) consists of a generally U-shaped member inserted in the tube and projecting portions (15, 16) formed in one piece with said member and intended to be guided in the opposite radial openings (12, 13) in the tube.

* * * * *